US009481103B2

(12) United States Patent
Carrasco

(10) Patent No.: US 9,481,103 B2
(45) Date of Patent: Nov. 1, 2016

(54) CUTTER FOR DIVIDING A PROCESSED PRODUCT USING ULTRASOUND ENERGY AND DEVICE

(75) Inventor: César Carrasco, Schocherswil (CH)

(73) Assignee: A O SHALLINOX GMBH, Schocherswil (CH)

( * ) Notice: Subject to any disclaimer, the term of this patent is extended or adjusted under 35 U.S.C. 154(b) by 239 days.

(21) Appl. No.: 14/125,229

(22) PCT Filed: Jul. 25, 2012

(86) PCT No.: PCT/EP2012/064616
§ 371 (c)(1),
(2), (4) Date: Dec. 10, 2013

(87) PCT Pub. No.: WO2013/014199
PCT Pub. Date: Jan. 31, 2013

(65) Prior Publication Data

US 2014/0116222 A1 May 1, 2014

(30) Foreign Application Priority Data

Jul. 26, 2011 (EP) ..... 11175306

(51) Int. Cl.
*B26D 7/08* (2006.01)
*B01F 11/02* (2006.01)
(Continued)

(52) U.S. Cl.
CPC ..... *B26D 7/086* (2013.01); *B01F 3/18* (2013.01); *B01F 11/0258* (2013.01); *B26D 1/0006* (2013.01); *B26D 2001/006* (2013.01); *B26D 2001/0053* (2013.01); *Y10T 83/8759* (2015.04)

(58) Field of Classification Search
CPC .... B01F 11/0258; B01F 3/18; B26D 1/0006; B26D 2001/006; B26D 7/086; B26D 2001/0053; B26D 11/10; B26D 7/08; Y10T 83/8759
USPC ..... 83/571, 835, 701, 956
See application file for complete search history.

(56) References Cited

U.S. PATENT DOCUMENTS 3,468,203 A 9/1969 Armelin et al.
5,058,273 A * 10/1991 Streger ..... B23D 51/10 30/164.9

(Continued)

FOREIGN PATENT DOCUMENTS

DE 1 561 733 3/1970
DE 103 14 444 A1 10/2004

(Continued)

OTHER PUBLICATIONS

Nov. 2, 2012 International Search Report issued in International Application No. PCT/EP2012/064616.

*Primary Examiner* — Ghassem Alie
(74) *Attorney, Agent, or Firm* — Oliff PLC

(57) ABSTRACT

A cutter that is used for dividing a processed product using ultrasound energy. The cutter includes a blade that has least one blade wing, the blade wing narrows at a front side towards a cutting edge, and that is adjoined at a rear side by a blade back. The blade back has a first side surface and a second side surface opposing one another. A mounting surface is provided on the first side surface of the blade back, and on the mounting surface a first end piece of at least one curved, coupling element is welded, and a second end piece of the mounting surface has a connecting member that is connected to an energy converter that supplies ultrasound energy to the blade.

18 Claims, 8 Drawing Sheets

(51) Int. Cl.
*B01F 3/18* (2006.01)
*B26D 1/00* (2006.01)

(56) References Cited

U.S. PATENT DOCUMENTS 5,768,970 A * 6/1998 Wolf ..... A21C 11/10 83/701
6,431,041 B1 * 8/2002 Rompa ..... B26D 1/11 83/168
2005/0265120 A1 12/2005 Naoe
2009/0003123 A1 1/2009 Morrison, Jr. et al.
2010/0020631 A1 1/2010 Gansmuller et al.
2010/0095534 A1 * 4/2010 Saiz ..... B24B 23/005 30/272.1
2010/0288092 A1 * 11/2010 Manger ..... B26D 7/086 83/13
2014/0249555 A1 * 9/2014 Kising ..... B26D 5/00 606/169

FOREIGN PATENT DOCUMENTS

FR 2 947 202 12/2010
JP A-60-144224 7/1985
WO WO 2008/148139 A1 12/2008

* cited by examiner

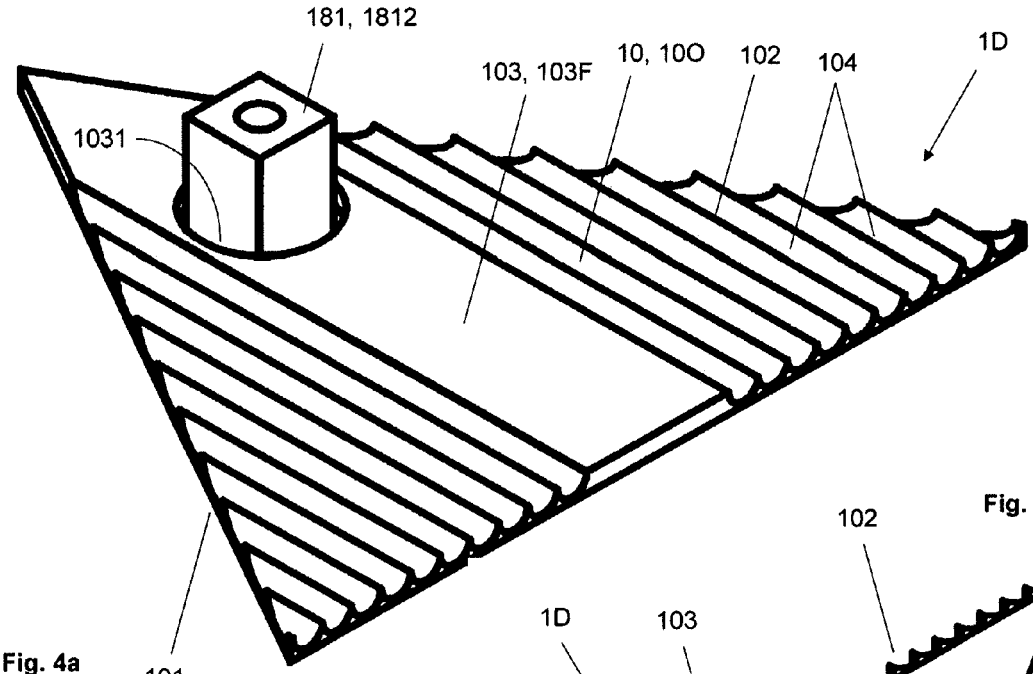
Fig. 4a
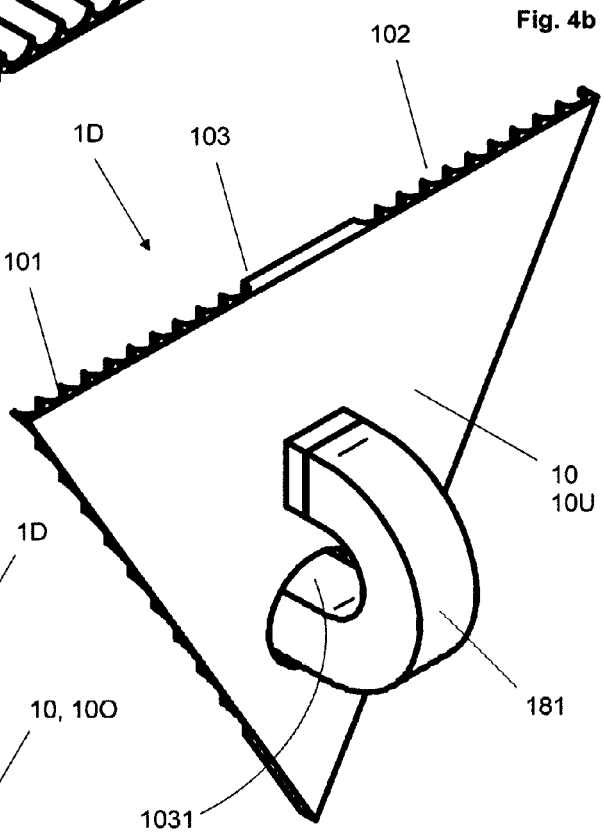
Fig. 4b
Fig. 4c
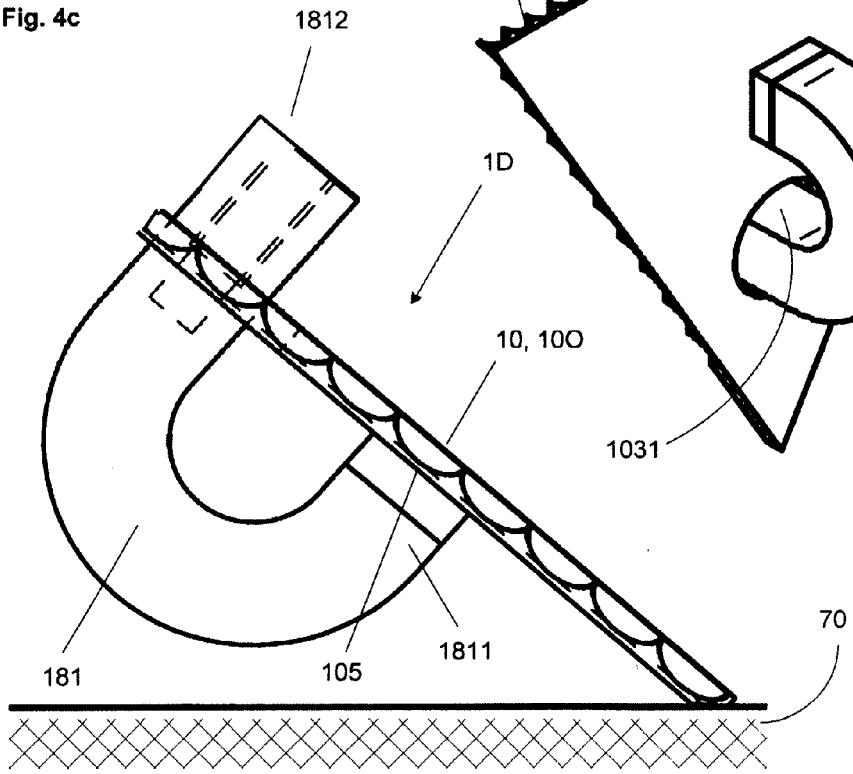

CUTTER FOR DIVIDING A PROCESSED PRODUCT USING ULTRASOUND ENERGY AND DEVICE

BACKGROUND

The invention relates to a cutter for dividing, particularly for cutting or atomising processed products using ultrasound energy as well as a device with at least one such cutter.

In numerous industrial applications, particularly in the food industry, products need to be provided with predetermined dimensions. E.g., portions of meat, sausages or cheese need to be provided as individual units or partitioned in slices. For this purpose, cutting devices, e.g. drives with rotating cutting discs are provided, which are guided with high chopping frequencies towards the products, in order to execute the required cuts. Devices of this kind require considerable efforts for manufacturing, for operation and for maintenance. The rotation of the cutting discs, which frequently need to be sharpened, causes a massive impact on the material, so that particles are split off and ejected thus causing a contamination of the device.

Furthermore, the cutting discs and the related operating parameters need to be adapted to the processed product, wherefore the field of application is limited or an individual control needs to be implemented. E.g., if soft bread shall be cut, then a high rotation speed is required, so that the bread is not compressed during the application of the cut. Furthermore the rotating cutting discs, together with the drive devices, require a lot of space, so that in view of the applied means, including the required facilities, a low efficiency results. Furthermore, products with large dimensions entail specific demands to the cutting device. Possibly the cutting disc needs to be guided along a path, in order to execute a desired cut with the required length.

Further, cutting devices are known from prior art with a cutter that is connected via an energy converter to a wave generator that provides electrical AC voltage with a frequency in the ultrasound region. The energy converter, which typically comprises piezo-electric elements, converts the electrical energy into mechanical energy, which causes a vibration of the cutter.

U.S. Pat. No. 3,468,203A (DE1561733A1) discloses a cutting device with a vibration device screwed to the back of a relatively small cutter, wherein the application of sound waves causes the cutter to vibrate.

DE 10314444 A1 discloses a device for cutting a product with a cutter that is axially pre-tensioned and that is connected to a piezo-electric actuator that introduces longitudinal waves into the cutter. Further, a wave generator, which generates transversal waves, is coupled to the cutter. Hence, this device requires at least two wave generators, in order to reach the desired effect of the cutter. In order to reach the desired effect, the wave generators need to be positioned accordingly, thus requiring correspondingly large space and reducing the potential applications of the cutter.

A further cutter that is designed for surgical applications and that is connected to a vibration device is known from WO2008148139A1. With this cutter mechanical vibrations with amplitudes from 0.0001 mm to 1 mm occur.

For larger cutters correspondingly larger and more complex vibration devices are required.

Further, in industrial processes, e.g. in the pharmaceutical industry or the food industry, often the necessity exists, to provide powdery materials evenly distributed to a receiver. E.g., the material needs to be added to a solid or liquid product, whereby lump formation shall be avoided. Furthermore, often different powdery substances need to be mixed evenly, which is reached by using mixers and stirrers often with considerable effort and a long process time only.

SUMMARY

Hence, the present invention is based on the object of providing a cutter, with which dividing, such as cutting or atomising, processed products is advantageously achieved, particularly in industrial applications, using ultrasound energy.

In particular, a cutter shall be provided, which for introducing ultrasound energy does not require two wave generators, which need to be mounted at different positions of the cutter in such a way, that the first wave generator generates longitudinal waves and the second wave generator generates transversal waves.

Further, a cutter shall be provided, which exhibits under the application of ultrasound energy optimal cutting properties on products having any possible consistency and which allows precise dividing of the products.

Furthermore, a cutter shall be provided, which can be applied on products in any possible production process and which exhibits optimal properties even with larger and longer products along the complete cutting line.

Further, use of the cutter in an inventive device shall lead to a significantly increased output of processed products.

Still further, the cutter shall be usable advantageously for evenly dividing and mixing powdery materials. Across the cutter, powdery processed products shall be transferable evenly distributed to a further processed product or shall be mixable with the further processed product, without requiring mixing in a fluid which otherwise may be required.

Furthermore, for operating one or more inventive cutters an advantageous device shall be provided.

This object is reached with a cutter as described herein and a device as described herein. Preferred embodiments of the invention are defined in some claims.

The cutter, which serves for dividing, particularly cutting or atomising, a processed product under the application of ultrasound energy, comprises a blade with at least one blade wing which narrows at the front side towards a cutting edge and which is connected at the rear side to a blade back, which comprises larger side surfaces opposing one another and smaller front surfaces at the exposed ends.

According to the invention a mounting surface is provided on the blade back or an extremity formed thereon, on which mounting surface a first end piece of at least one curved, preferably U-shaped coupling element is welded, whose second end piece exhibits a connecting member, preferably a threaded bore, that is connectable to an energy converter, which serves for supplying ultrasound energy.

The distance between the mounting surface and the cutting edge is selected in such a way that cutting processes are not obstructed. Preferably the mounting surface is at a position, at which the blade does not yet tapper towards the cutting edge. Advantageously the mounting surface lies at a plane side surface of the blade back or the extremity. Due to the advantageous coupling the ultrasound energy can also be transferred advantageously into the blade body via the extremity that is connected in one part to the blade back.

Hence, the blade can be formed as desired and can be adapted by means of the extremity to any desired application. E.g., the blade may form a hollow cylinder that is provided on one side or both sides with a cutting edge. Thereby, the body can merely form the blade or can in addition be connected in one part to an extremity that is formed as desired and welded to the coupling element. The blade preferably comprises a blade back with only one blade wing on one side or with two blade wings on opposite sides extending in different directions and on which blade back the first end piece is welded on a side surface.

The application of ultrasound energy, e.g. with an operating frequency of 35 kHz provides surprising properties to the inventive cutter. The ultrasound energy is coupled into the blade via the large side surfaces of the blade back transverse to the at least one cutting direction of the cutter. Thereby, a first end piece of the coupling element extends preferably perpendicularly to the blade. By the application of ultrasound energy not a vibrating motion in direction of the cutting direction appears as seen with the known cutters. Instead, elastic waves result within and/or on the surface of the blade, which intensify towards the cutting edge. Suitable waves occur when using a curved or bent embodiment of the coupling elements, which are preferably U-shaped.

Due to the inventive coupling of the ultrasound energy, ideal waveforms result without requiring two wave generators, which need to be mounted at different positions on the cutter, in order to couple, separated from one another, longitudinal waves and transversal waves into the cutter. Hence, the cutter can be used in a broader application range, since a second wave generator does not appear disturbingly. Further, by avoiding a second wave generator efforts for manufacturing the cutter are reduced.

Thereby it is advantageous to mount a shorter first end piece of the coupling element on one side of the blade and to guide a longer second end piece of the coupling element by means of an arc around the blade back or through an opening in the blade back to the other side of the blade. In preferred embodiments the two end pieces of the coupling element extend in parallel.

The coupling element is for example a curved bar made from steel with a round profile or a polygonal profile and a length preferably in the range from 5 cm to 30 cm. The diameter or the edge length of the bar lies preferably in the range from 8 mm to 16 mm.

By coupling the ultrasound energy via the curved coupling piece perpendicularly into the blade, an advantageous pattern of mechanical waves occurs, which extend across the blade. By the inventive coupling of the ultrasound energy into the blade back not only an optimal distribution of the energy within the blade back and a significant augmentation of the mechanical waves in the range of the cutting edge are reached. At the same time, by the optimal distribution of the energy, a punctual overload of the blade is avoided that could lead to the destruction of the cutter. Hence, ultrasound energy can advantageously be introduced into the blade at that operating frequency, at which the blade can absorb maximum power. Due to the quick distribution of mechanical waves within the blade back, on the one hand local heating is avoided and on the other hand an optimal effect of the cutting edges is reached.

Preferably, a frequency modulated signal is supplied to the energy converter connected to the blade, which signal preferably comprises a frequency deviation in a range from 1% to 10% of the operating frequency and preferably a modulation frequency in the range from 50 Hz to 1000 Hz. The frequency modulation ensures that the cutter is always operated in the optimal range of operation independently of external thermal and mechanical impacts.

The blade back comprises an increased material thickness typically in the range from 3 mm to 10 mm. For longer or shorter cutters or when applying higher energy levels then the material thickness is adapted accordingly. It is particularly advantageous that the inventive effect can be achieved with cutters of practically any length, by which ultrasound energy is applied via coupling elements preferably in even distances of for example 30 cm to 90 cm. Hence, inventive cutters can be used for any application. E.g., cutters can be used in the paper industry in order to cut paper traces of maximal width. In the majority of applications, particularly in the food industry, cutter lengths of 0.5 m to 1.5 m are used. However, even cutter lengths of several meters, e.g. 8 m and more can be used.

The ultrasound energy coupled into the blade does not cause perceptible vibrations, but recursive material expansions with material displacements in the nanometer range as well as material oscillations having a surprising effect on the processed material. In the range of the cutting edge besides longitudinal waves strong transversal waves appear, which run transverse to the cutting direction. By these subtle waves and oscillations, a dividing effect results that is far more intense than the dividing effect, which occurs under the impact of force or vibrations. The cutter can penetrate and divide finest structures. By the combination of mechanical waves, which are described for example in Brian M. Lempriere, Ultrasound and Acoustic Waves, Academic Press, London 2002, an optimal effect is reached. Thereby, the cutting edge is subject to longitudinal strain and transversal movements, which break up the structures without damaging them further.

In the processed products not only precise cuts result, but also optimal cutting surfaces.

By means of the mechanical longitudinal waves and transversal waves, soft or hard processed products are divided in the range of the blade without the need of applying force. As a consequence, even very soft processed products are not subject to deformation when processed and can therefore precisely be cut. E.g., soft bread can be cut in slices having minimal thickness. In addition, due to the avoidance of a force impact the cutting edge of the blade is also spared, so that sharpening of the blade will be required after a long operational period only.

The inventive cutter can have a large length, so that a plurality of products transported on a band-conveyor can be processed. In a particularly preferred embodiment the cutter comprises a double blade, so that with each movement of the blade, i.e., when lifting and lowering the blade, a process cycle can be executed. In this manner, the output of processed products can be doubled.

In preferred embodiments the cutting edge of one or both blade wings is provided with a wave-shape or a toothwork, which exhibits an even more intense effect and processes the processed product practically in two steps. The first step the wave-shapes or teeth engage in the processed product and divide it partially, whereafter in a second step the remaining part is divided. The wave-shape has further the effect that the freely exposed wave-shapes of the cutting edge can oscillate even more intense, wherefore the effect of the inventive action is further enforced.

In particularly preferred embodiments the upper side of the blade, optionally only one of the upper sides of the blade wings, is provided with a wave-shape with wave hollows or grooves that extend perpendicular or transverse to the cutting edge. This embodiment of the blade has the effect of improving the distribution of the ultrasound energy.

The blade that is provided with a wave-shape can also advantageously be used for the transport and the even distribution of a powdery processed product. In this embodiment of the blade, the processed product is evenly distributed across the upper side of the blade and is transported along the grooves to the cutting edge, where it is atomised and is then sinking in form of a homogeneous mist. If two inventive knifes are arranged below or beside one another, then the powdery mists of each processed product are ideally mixed and form a practically homogeneous mixture with a mixing degree that else can only be reached after long stirring in a liquid.

If each powdery processed product is supplied to the related cutter with a specified dosage, then an optimally mixed mixture with a selectively determined product ratio is obtained.

The distance between the wave hollows or grooves on the operation surface of the blade is preferably selected depending on the wavelength of the ultrasound waves. Preferably, the distances of the grooves are selected in the range from 5 mm to 15 mm and the amplitude of the wave segments of the wave-shape is selected in the range from 0.5 mm to 4 mm.

The upper side of the blade, which serves for transporting processed products, forms preferably a flat plane. The lower side of the blade comprises in the range of the blade back an area aligned in parallel to the upper side and in the range of the first and/or second blade wing a plane inclined towards the related cutting edge.

In inventive devices, the cutter is connected via the at least one coupling element and an energy converter mounted thereto each to a generator, which provides, preferably controlled by a programmable control unit, an electrical AC-voltage in the frequency range of the ultrasound, preferably in the range between 30 kHz and 40 kHz.

BRIEF DESCRIPTION OF THE DRAWINGS

Below the invention is described in detail with reference to the drawings:

FIG. 4*a* shows a fourth inventive cutter 1D from above in a triangular embodiment with a blade back 103, through which an end piece 1821 of a coupling element 181 is guided, and with blade wings 101, 102 narrowing towards the top;

FIG. 4*b* shows the fourth cutter 1D of FIG. 4*a* from below with the coupling element 181, whose first end piece is welded to the lower side 103U of the blade back 103;

FIG. 4*c* shows the use of the fourth cutter 1D for providing a powdery processed product to a product 70;

DETAILED DESCRIPTION

Figure 1A:
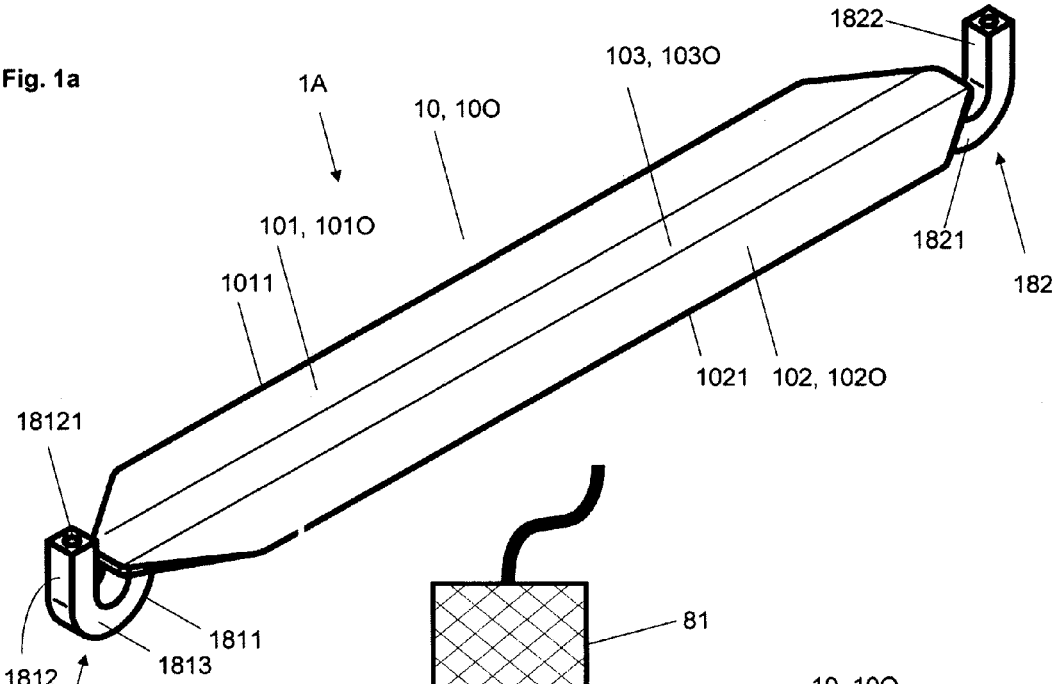
FIG. 1*a* shows a first inventive cutter 1A with a double blade 10, which comprises a first and a second blade wing 101, 102 narrowing each towards a related cutting edge and enclosing a blade back 103 arranged between, which exhibits an elevated material thickness and to which two U-shaped coupling elements 181, 182 are welded.

FIG. 1*a* shows the upper side of a first inventive cutter 1A, which comprises a double blade 10, having a first and a second blade wing 101, 102 narrowing towards the related cutting edge 1011, 1021. As shown in FIG. 1*a* and FIG. 1*c*, the blade wings 101, 102 enclose a blade back 103 lying there between, which exhibits an elevated material thickness and which is integrated into the blade 10 as a small cuboid. The upper sides 101O, 101U of the blade wings 101, 102 form together with the upper side 103O of the blade back 103 in this preferred embodiment a flat plane, while the lower sides 101U, 102U of the blade wings 101, 102 are inclined relative to the lower side 103U of the blade back 103 towards cutting edges 1011, 1021.

At both ends of the lower side 103U of the blade back 103 a U-shaped coupling element 181, 182 is welded, each with a first end piece 1811 on a mounting surface 105, which first end piece 1811 is aligned perpendicular to the lower side 103U of the blade back 103 and thus perpendicular to the cutting direction of the cutter 1A. Hence, the mounting surface 105, which shown hatched, is therefore part of the area of the lower side 103U of the blade back 103, to which the end piece 1811 of the coupling element 181 is welded. The coupling elements 181, 182 welded to the lower side 10U of the blade 10 extend with an arced intermediate member 1813 along the axis of the blade back 103 into opposite directions towards the outside. The arced intermediate member 183 extends along an arc of 180°, so that the shorter first and the longer second end piece 1811, 1812 of the coupling element 181 are aligned in parallel to one another.

Figure 1B:
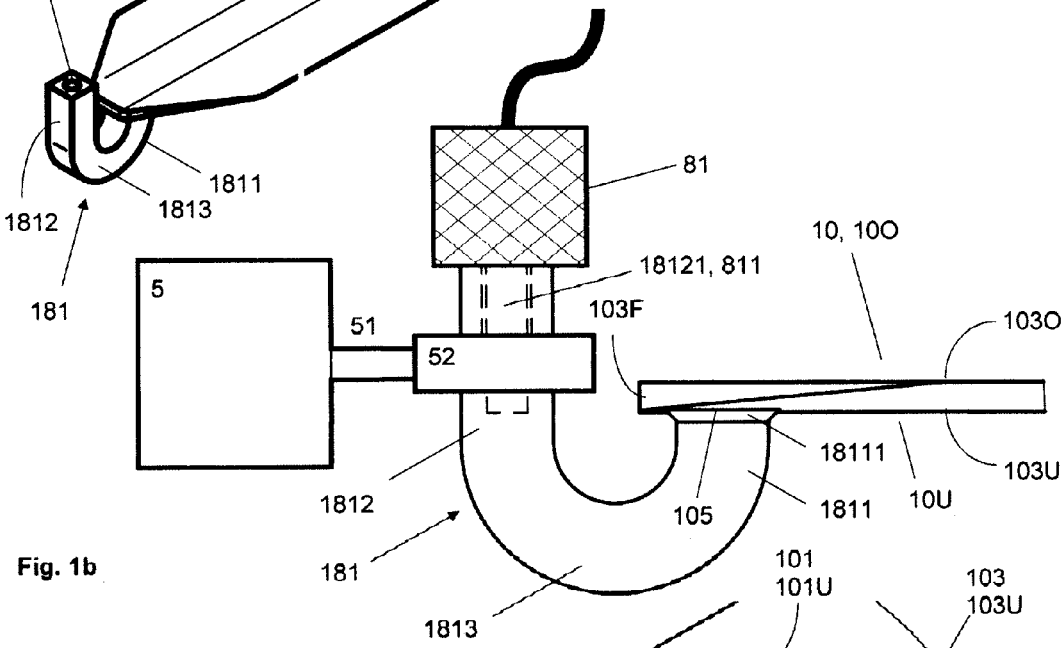
FIG. 1*b* shows one of the coupling elements 181 of FIG. 1*a* that is provided with an energy converter 81 and that is held by means of a mounting element 52 with a drive arm 51 of a drive device 5.
Figure 1C:
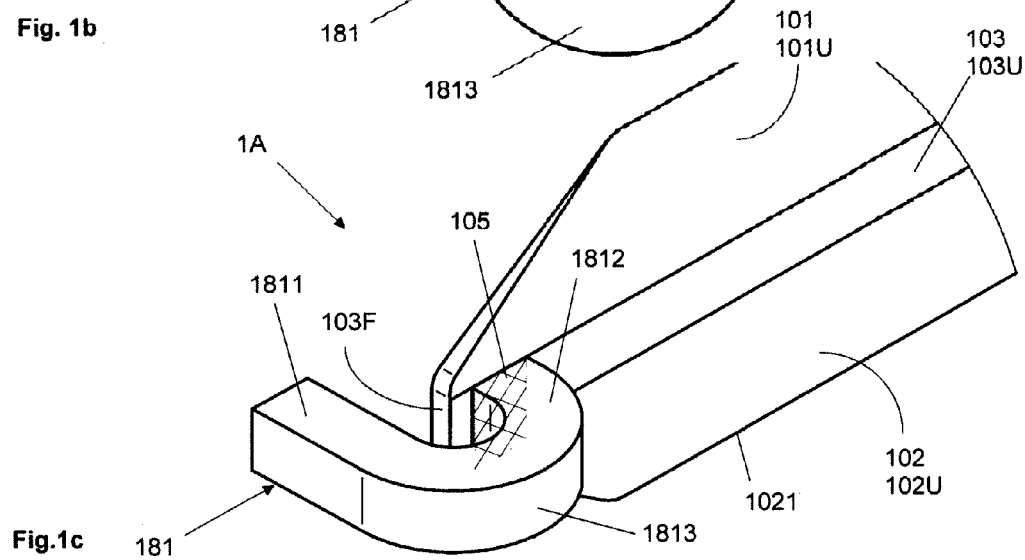
FIG. 1*c* shows from below, an end piece of the inventive cutter 1A of FIG. 1*a* with the coupling element 181 welded to the lower side 103U of the blade back 103.

FIG. 1*b* shows that the freely exposed second end pieces 1812, 1822 of the coupling elements 181, 182 are provided with connecting elements 18121, such as threaded bores, which are connectable with a connecting member 811, such as a screw, of an energy converter 81, which supplies ultrasound energy.

Figure 6:
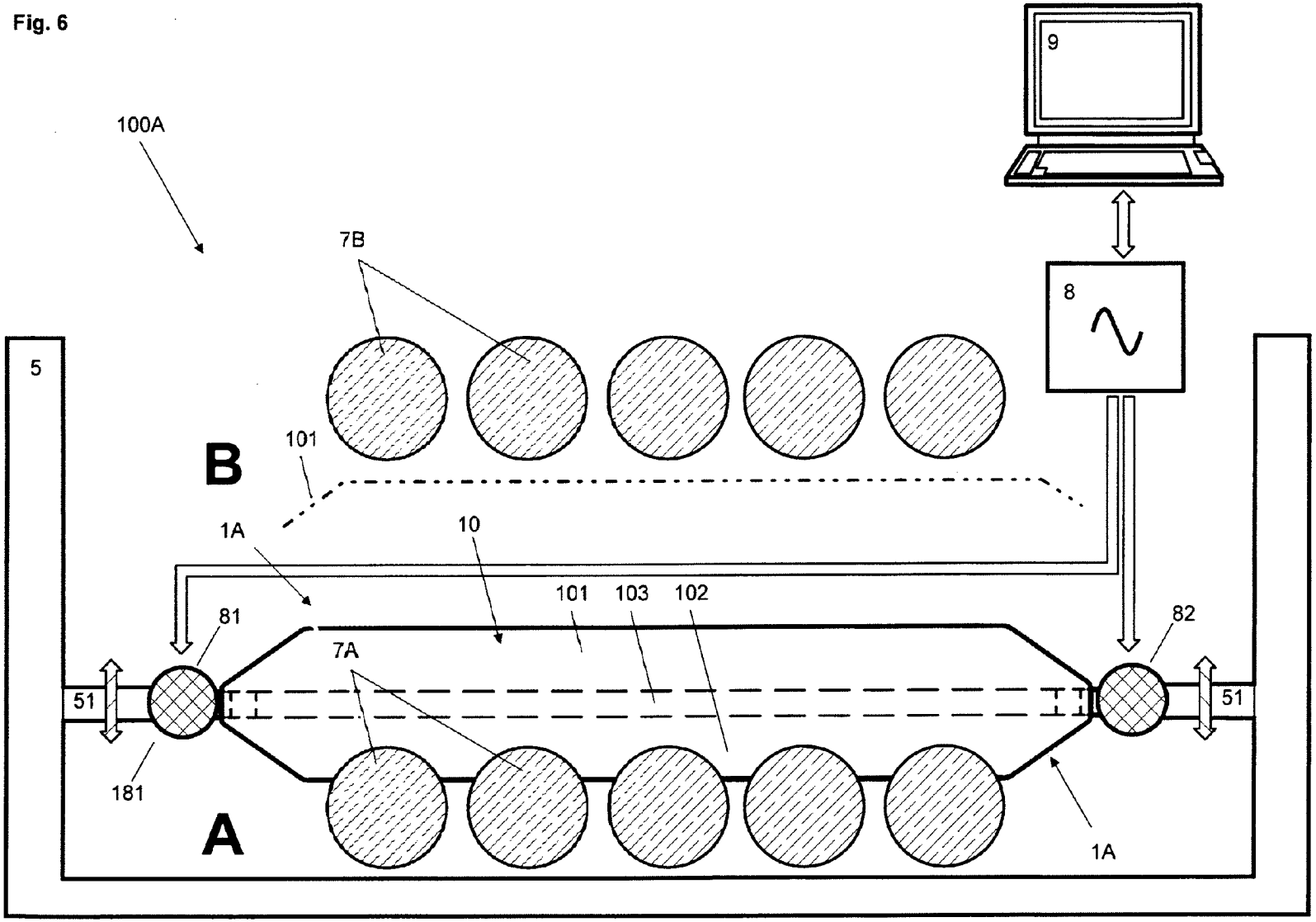
FIG. 6 shows a first inventive device 100A equipped with the first cutter 1A of FIG. 1*a*, with which two product groups 7A and 7B transported on both sides of the cutter 1A can be processed.

The cutter 10 is forged from metal and is preferably coated with a metal layer. The coupling elements 181, 182, which exhibit the form of a bow, are produced for example from a bar that exhibits a square profile. By welding the coupling elements 181, 182 to the blade back 103 an optimal coupling of the ultrasound energy results. Further, a stable connection results that allows using the coupling elements 181, 182, which serve for coupling ultrasound energy, also for mechanical coupling to a drive device 5. For this purpose, as shown in FIG. 1*b* and FIG. 6, preferably the second end piece 1812 of the coupling element 181 is connected by means of a mounting element 52 to a drive arm 51 of a drive device 5 that can vertically be moved.

Figure 2A:
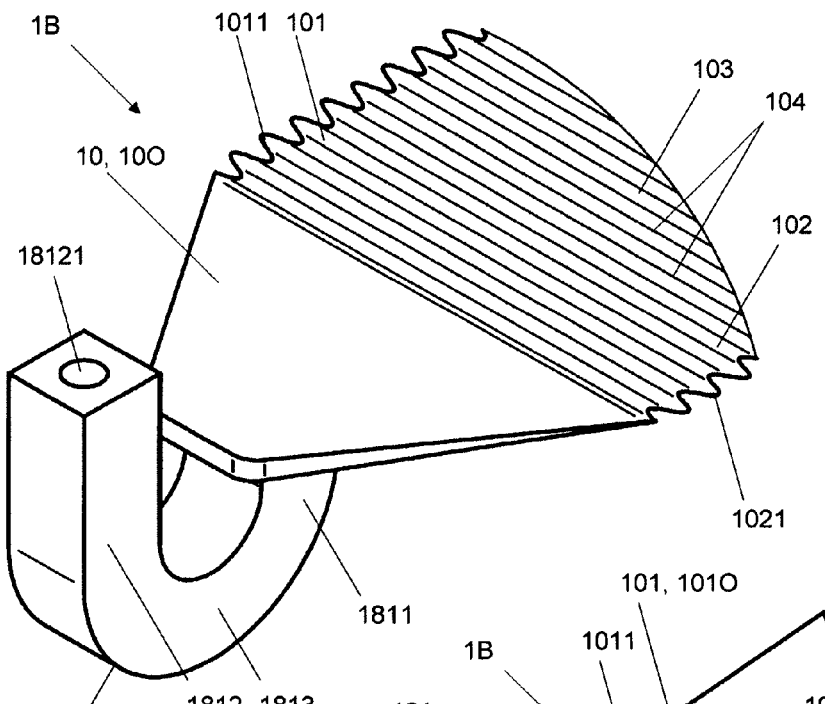
FIG. 2*a* shows a part of a second preferably designed cutter 1B from above with a blade 10, whose cutting edges 1011, 1021 are provided each with a wave-shape and whose upper side 100 is provided with grooves 104 extending in cutting direction, which are formed by a wave-shape extending transverse to the cutting direction.

FIG. 2*a* shows a part of a cutter 1B in a further preferred embodiment with two blade wings 101, 102, whose cutting edges 1011, 1021 exhibit a wave-shape. Due to the wave-shape, freely exposed wave segments are proved, which can more easily oscillate than a cutting edge that is aligned along a line. Hence, when supplying ultrasound energy the wave segments of the cutting edges 1011, 1021 can oscillate more easily and with higher amplitudes, wherefore the blade 10 can more easily penetrate into a processed product.

It has been found that the cutter 1B can not only be used for cutting, but also outstandingly for atomisation of a powdery processed product. A powdery processed product, which is transported across the inclined blade 10, is atomised at the cutting edges 1011, 1021, i.e. is divided into smallest particles and is ejected by the laterally oscillating wave segments.

In order to reach an even dividing of the powdery processed product, it is ensured that the ultrasound energy is evenly distributed across the blade 10. For this purpose, preferably a wave-shape pattern is provided on the upper side 100 of the blade 10, which comprises ridges and grooves 104 that preferably correspond to the wave-shape of the cutting edges 1011, 1021. The powdery processed product can get evenly distributed across the wave pattern and can migrate along the grooves 104, which preferably extend from the first to the second cutting edge 1011, 1021, towards the first or second cutting edge 1011; 1021.

Figure 2B:
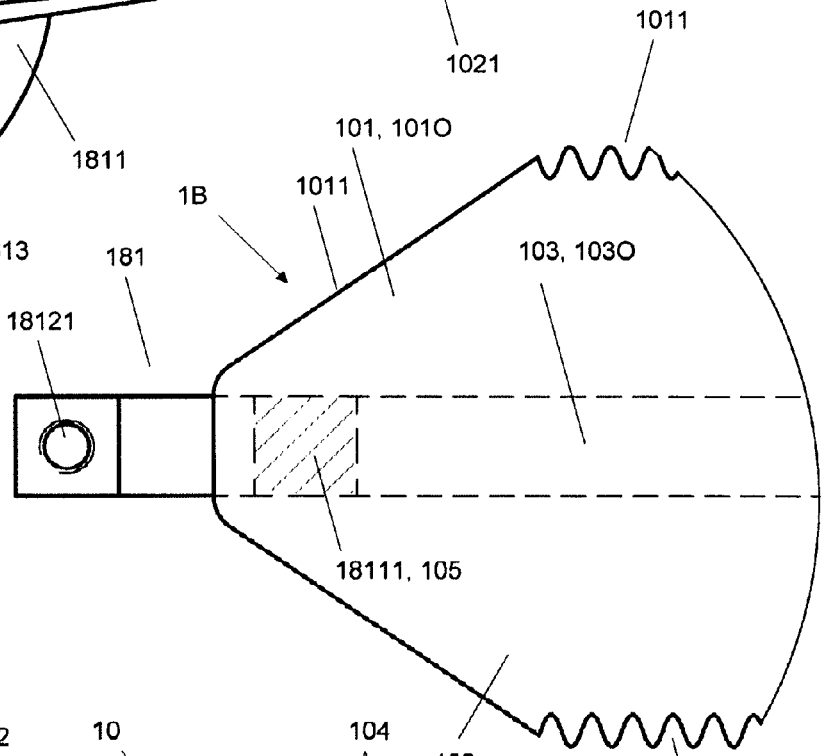
FIG. 2*b* shows a part of the cutter 1B of FIG. 2*a* from above.

FIG. 2*b* shows the connection point 18111 via which the first end piece 1811 of the first coupling element 181 is connected planar, i.e. with the mounting surface 105 at the lower side 103U of the blade back 103. By this embodiment of the coupling elements 181, 182 and the advantageous coupling to the blade 10, surprising properties of the cutter 1 result, which is suitable for dividing, i.e. cutting and atomising, practically any processed product.

Figure 2C:
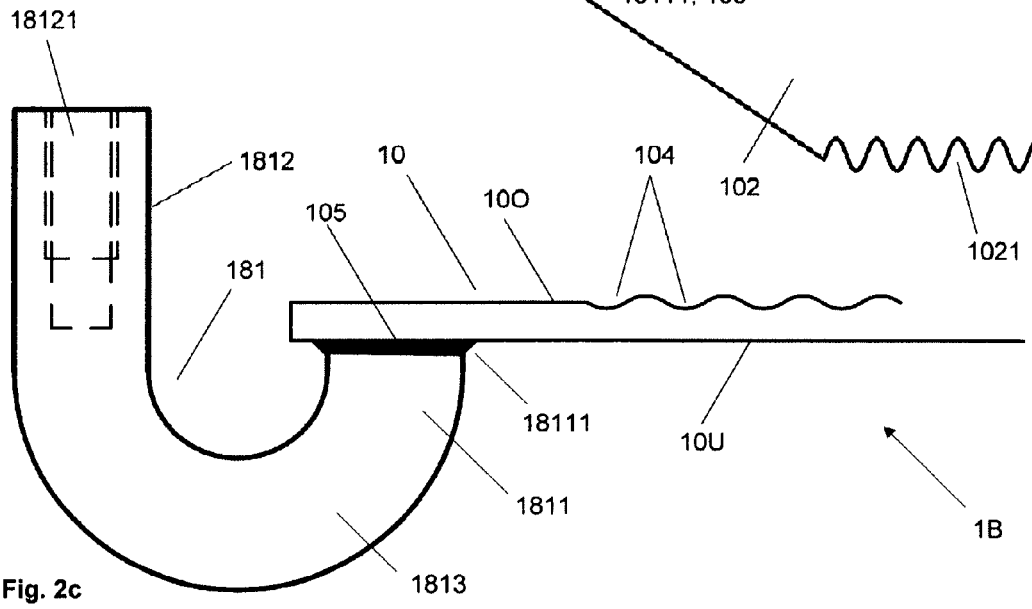
FIG. 2*c* shows the part of the cutter 1B of FIG. 2*a* from the side.

FIG. 2*c* shows the upper side 100 of the blade 10, which is provided with a wave pattern with wave hollows, i.e. grooves 104 that are aligned perpendicular to the cutting edges 1011, 1012.

Figure 3A:
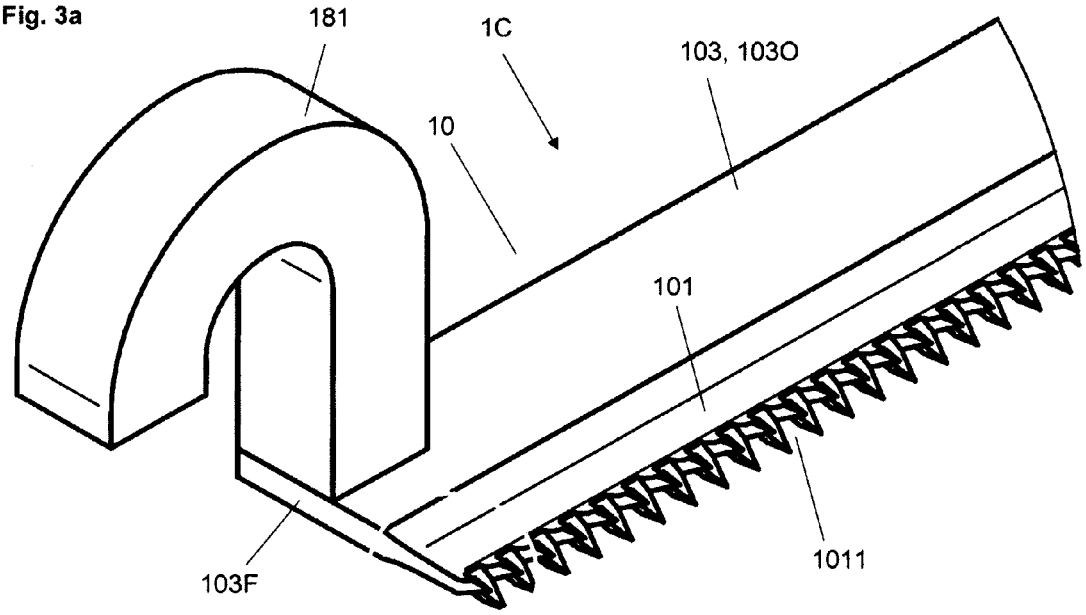
FIG. 3*a* shows an end piece of a third inventive cutter 10, which comprises a blade back 103 with only one blade wing 101, whose cutting edge 1011 is toothed.

FIG. 3*a* shows a further inventive cutter 1C with a blade 10 that is provided with a blade back 103 and only one blade wing 101 extending therefrom.

Figure 3B:
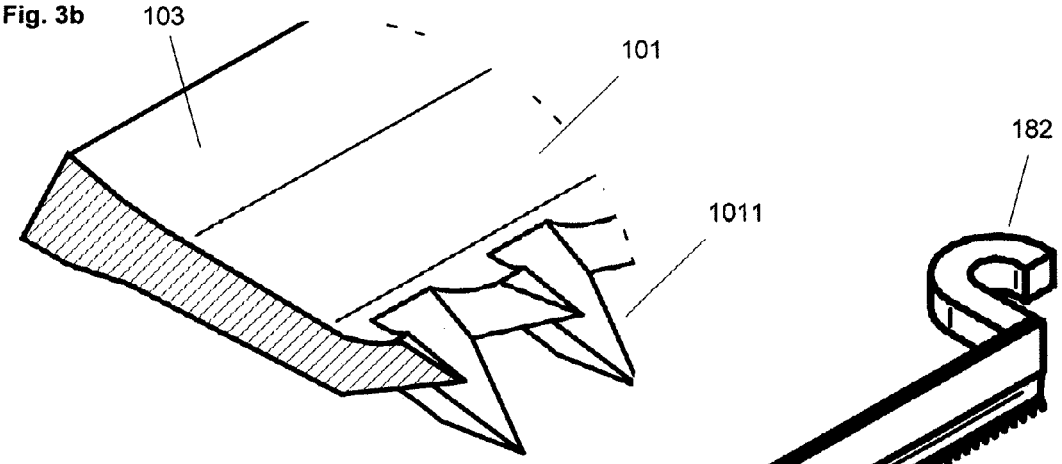
FIG. 3*b* shows a cut through the blade 10 of the cutter 1*c* of FIG. 3*a* and FIG. 3*c;*
Figure 3C:
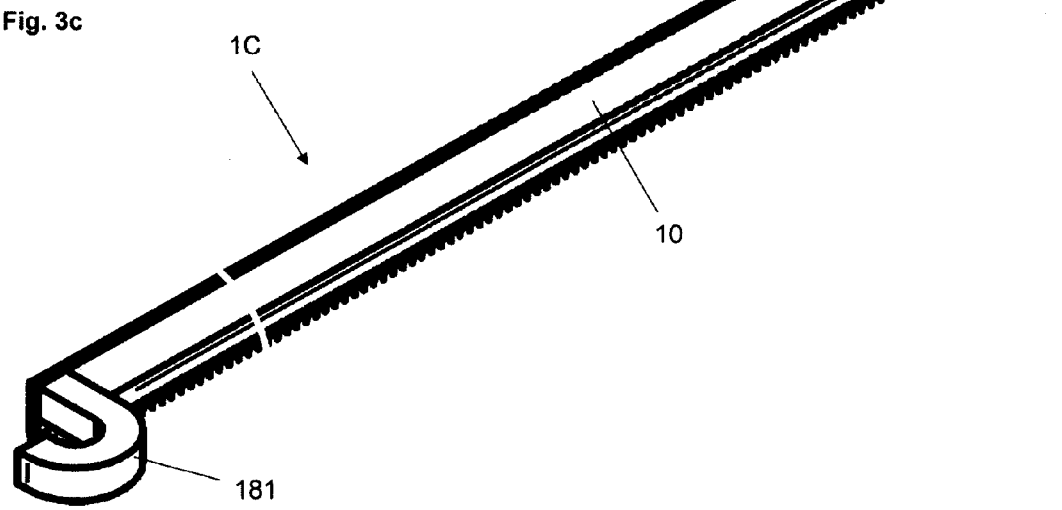
FIG. 3*c* shows the third inventive cutter 10 with two coupling elements 181, 182 that are coupled to opposite sides 103U, 103O of the blade back 103.

The cutting edge 1011 of the blade wing 101 is provided with a toothwork that is shown enlarged in the sectional view of FIG. 3*b*. FIG. 3*c* shows the complete cutter 1C, which comprises two coupling elements 181, 182, that are welded onto different sides 103U; 103O of the blade back 103.

This cutter 1C allows dissolving and converting a solid block of a processed product into powdery form. For this purpose, the cutter 1C, which is supplied with ultrasound energy, is guided towards the solid block of the processed product and the powder is removed in layers.

Furthermore, the cutter 1C allows optimally mixing different powdery substances within a container. For this purpose, the cutter 10 is guided into the centre of the container and is supplied with ultrasound energy, whereafter at least two types of a powdery processed product are evenly mixed independently of the specific weight of each type.

FIG. 4*a* shows a fourth inventive cutter 1D in a triangular embodiment. The cutter 1D comprises a blade back 103, through which an end piece of a coupling element 181 is guided and which is provided with blade wings 101, 102 which are narrowing towards the outside up to the top. The blade wings 101, 102 exhibit wave-shapes with grooves 104 extending in parallel to the blade back 103.

FIG. 4*b* shows the lower side of the fourth cutter 1D.

FIG. 4*c* shows the use of the fourth cutter 1D for delivering powdery, optionally crystalline processed products, such as sugar or salt, to a product 70. The cutter 1D is guided with the lower edge above the product 70, while the powdery processed product evenly distributed across the grooves 104 is delivered thereto. Due to the even distribution of the powdery processed product an optimal effect can be achieved. Undesirable local concentrations of the powdery processed product, which could lead to irritations in taste, are avoided. At the same time, the complete surface is evenly covered, so that the desired effect is achieved homogeneous across the complete surface. Hence, the inventive cutter 1D allows efficient and economical use of the available processed products. It is shown that the mounting surface 105 is arranged on the lower side of the blade back 103.

Figure 5A:
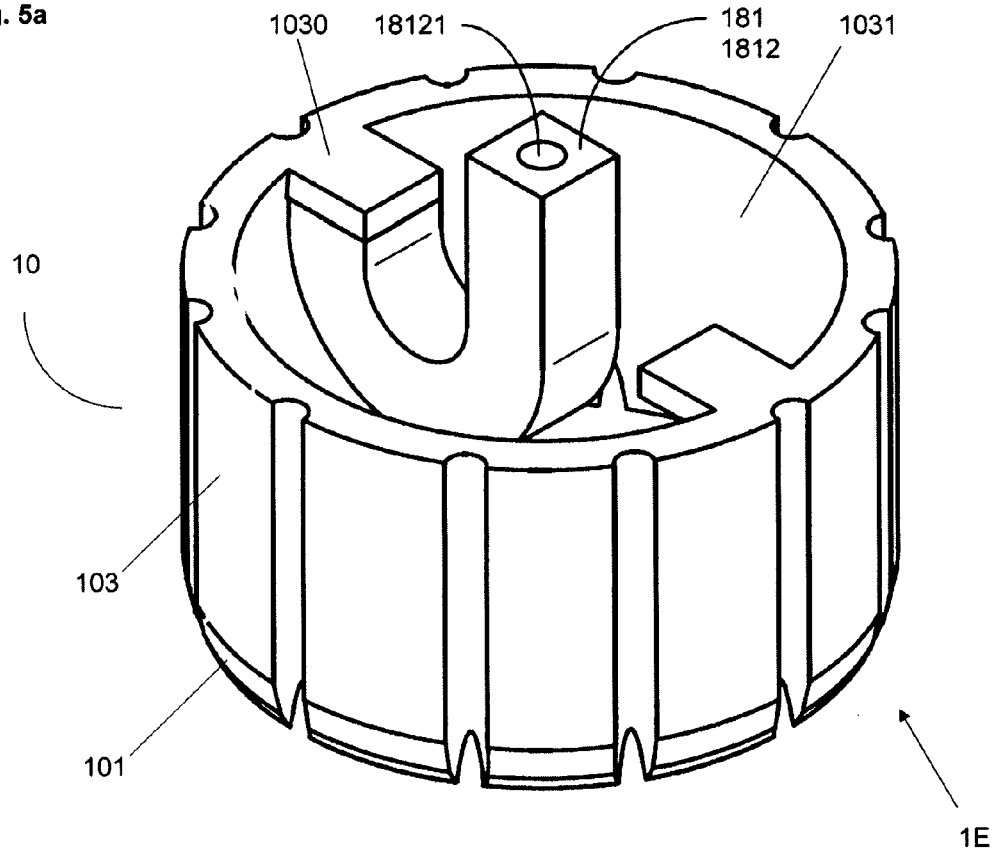
FIG. 5*a* shows a fifth inventive cutter 1E in the embodiment of a cup, which is completely opened downwards, with a reduced blade back 103 and with a blade wing 101 that is completely closed in itself thus forming a cylinder wall.

FIG. 5*a* shows a fifth inventive cutter 1E in the embodiment of a cup, which is completely opened downwards, and with blade 10, completely closed in itself comprising a hollow cylindrical blade back 103, which at the lower side is provided with the blade wing 101 having an annular cutting edge, and which at the upper side is provided with an extremity that is connected in one piece to the blade back 103 and that exhibits the form of a flange element 1030. The flange element 1030 has a mounting surface 105, to which the first end piece 1811 of the coupling element 181 is welded. The flange element 1030 forms a part or an extremity of the blade back 103, whereby optimal coupling of ultrasound energy is reached, although the flange element 1030 is inclined relative to the hollow cylindrical blade back 103. The inclined form and alignment of the flange element 1030 allows positioning the coupling element 181 at a location, where it does not disturb, but is suitable for installation purposes.

Figure 5B:
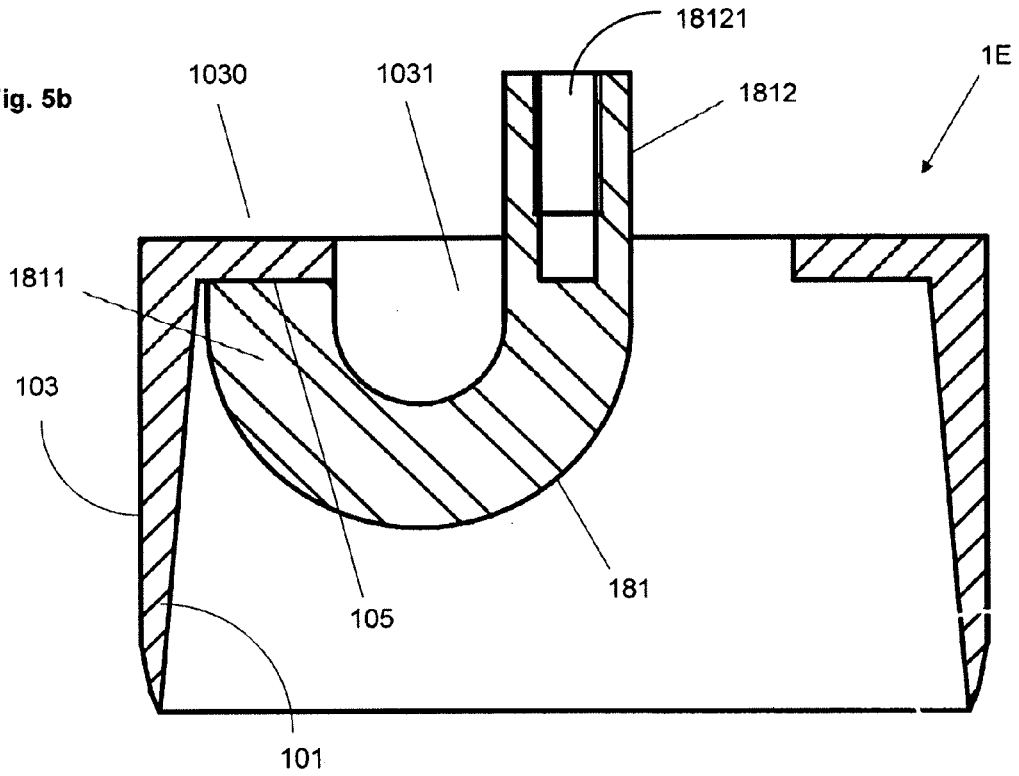
FIG. 5*b* shows a cut through the fifth cutter 1E of FIG. 5*a;*

The cutter 1E shown in FIG. 5*a* and FIG. 5*b* allows dividing and optionally evenly mixing a larger solid processed product with a further processed product. FIG. 5*b* shows a cut through the fifth cutter 1E of FIG. 5*a*.

FIG. 6 shows first inventive device 100A that is equipped with the first cutter 1A of FIG. 1*a*, with which the two product groups 7A and 7B, which are transported on both sides of the cutter 1A can alternately be processed. As shown in FIG. 1*b*, the cutter 1A is held on both sides with arms 51 of a drive device 5, with which the cutter 1A horizontally aligned with its longitudinal axis and the transversal axis with the vertically aligned blade wings 101, 102 can be driven downwards and upwards. When driving the cutter 1A downwards in a first process step A the first product group 7A and when driving the cutter 1A upwards in a second process step B the second product group 7B is processed. With this device 100A productivity of the processes can be doubled. It is thereby particularly advantageous that for moving the cutter 1A no significant forces need to be applied, wherefore the process steps can be executed with high precision even when simultaneously processing a plurality of products.

Figure 7:
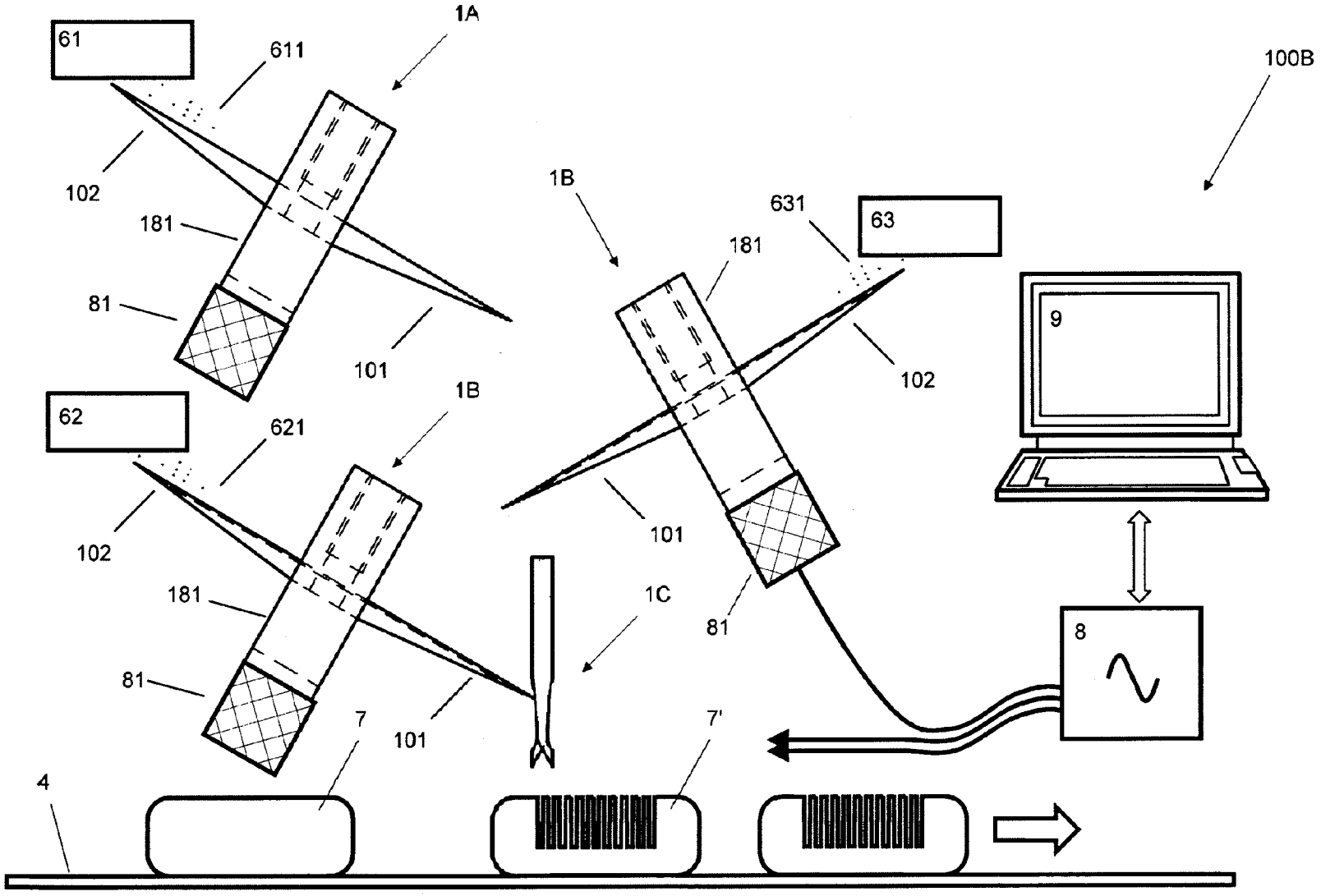
FIG. 7 shows a second inventive device 100B, with a first cutter 1A according to FIG. 1*a*, two second cutters 1B according to FIG. 2*a* and one third cutter 10 according to FIG. 3*c*, with which powdery materials 611, 612, 613 are evenly distributed, evenly mixed and added to products 7, into which cuts are inserted by means of the third cutter 1C.

FIG. 7 shows a second inventive device 100B, with a first cutter 1A according to FIG. 1*a* and two second cutters 1B according to FIG. 2*a*, with which each a powdery processed product 611, 612, 613 can get evenly distributed and evenly mixed. The resulting mixture is inserted into products 7, into which cuts are incorporated by means of a third cutter 1C according FIG. 3*c*.

The powdery processed products 611, 621, 631 are delivered from supply devices 61, 62 and 63 to said cutters 1A and 1B and atomised by the cutters 1A and 1B and forwarded to a common mixing zone, in which an optimally mixed powdery mist results, which is either captured in containers or, as shown in FIG. 7, is provided to a product 7.

FIG. 7 shows further, that soft products 7, 7' can be provided with deep cuts without causing a deformation of the product as is typical with conventional devices.

Figure 8:
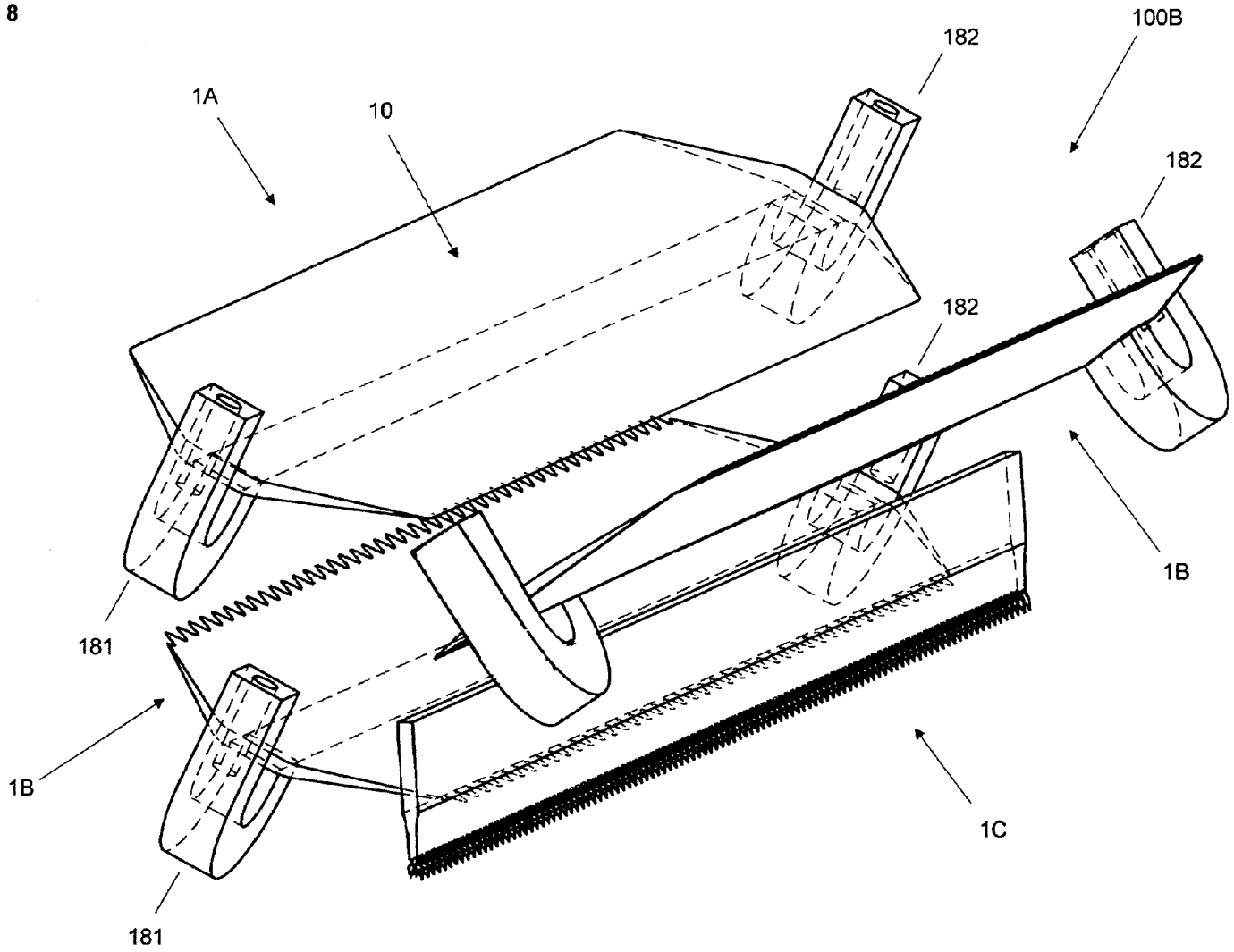
FIG. 8 shows the combination of the cutters 1A, 1B and 10 of FIG. 7 in spatial view.

FIG. 8 shows the combination of the cutters 1A 1B and 1C of FIG. 7 in spatial view. It can be seen that the device 100B, which allows optimally mixing and processing different processed products, requires little space. The individual cutters 1A, 1B and 1C can be held at the coupling elements 181, 182 by holding devices and drive devices and can optionally be shifted.

For controlling the devices shown in FIG. 6 and FIG. 7 and the processes a control device 9 is provided, which controls the drive device 5 and preferably also a generator 8, which delivers electrical signals to energy converters 81 that are connected to the coupling elements 181, 182 of the cutters 1A, 1B, . . . . The individual cutters 1A, 1B, . . . are preferably controlled individually depending on the properties of the cutters and the properties of the processed products 611; 621; 631 and 7A, 7B. The frequency of the delivered signals is preferably selected in such a way that the maximum energy is transferred. Preferably, frequency modulated signals are used, as described above.

The invention claimed is:

1. A cutter for dividing a processed product using ultrasound energy, comprising a blade that comprises at least one blade wing, the blade wing narrows at a front side towards a cutting edge, and that is adjoined at a rear side by a blade back, the blade back comprises a first side surface and a second side surface opposing one another, wherein a mounting surface is provided on the first side surface of the blade back, and on the mounting surface a first end piece of at least one curved, coupling element is welded, and a second end piece of the mounting surface has a connecting member that is connected to an energy converter that supplies ultrasound energy to the blade, wherein the at least one coupling element has one side welded to the blade and includes a bar with a round profile or a polygonal profile.

2. Cutter according to claim 1, wherein the blade comprises a blade back, on which on one side a blade wing is provided or on which on both sides blade wings are provided that are directed into opposite directions and on which the first end piece of the coupling element is welded on a side surface.

3. Cutter according to claim 1, wherein at each end of the blade back, on the one or the other side surface, a coupling element is provided and/or that along the blade back, on the one or the other side surface in a distance of 30 cm-90 cm a coupling element is provided each.

4. Cutter according to claim 1, wherein the cutting edge of the at least one blade wing exhibits a wave-shape or a toothwork and/or that the upper side of the blade, which serves for the transport of material, or at least one of the upper of the blade wings exhibits a wave-shape with wave hollows or grooves extending perpendicularly or transverse to the cutting edge.

5. Cutter according to claim 4, wherein the distance of the wave hollows or grooves, which preferably is selected depending on the wavelength of the ultrasound waves, lies in the range from 5 mm to 15 mm and/or that the amplitude of the waves lies in the range from 0.5 mm to 4 mm.

6. Cutter according to claim 1, wherein the blade comprises a plane upper side and a lower side with the lower side of the blade back aligned in parallel to the upper side of the blade back and with the dead two inclined lower side of the first and, if provided, second blade wing.

7. Cutter according to claim 6, wherein the upper side and the lower side of the blade back extend in parallel to one another and/or exhibit a mutual distance in the range from 3 mm to 12 mm, which is selected preferably with regard to the length of the blade, which preferably is selected in the range from 0.5 m to 8 m.

8. Device with a cutter according to claim 1, wherein the cutter is connected via the at least one coupling element and an energy converter mounted thereto each to a generator, which provides and electrical AC voltage in the frequency range of the ultrasound, preferably in the range between 30 kHz and 40 kHz.

9. Device according to claim 8, wherein the generator allows adjustment and supply of a signal, a) which signal has an operating frequency that is selectable in such a way, that the maximum power is transferred to the cutter and/or b) which signal is frequency modulated with a frequency deviation in a range from 1% to 10% of the operating frequency and is selected with a modulation frequency preferably in the range from 50 Hz to 1000 Hz.

10. Device according to claim 8, wherein a drive device with drivable or turnable drive arms is provided, which hold the cutter that is provided with two cutting edges preferably at the coupling elements, so that the cutter can be deflected in both cutting directions, in order to process in a first process step a first processed product and in a second process step a second processed product.

11. Device according to claim 8, wherein one or a plurality of supply devices are provided, from which each powdery processed products can be supplied to the upper blade side of a the related cutters, that preferably comprise grooves and a wave-shaped or toothed cutting edge and that are inclined into the direction of supply, so that the powdery processed products can be supplied evenly distributed to a receiver, such as a finished product.

12. Device according to claim 11, wherein a plurality of supply devices is provided, from which each a powdery processed product can be supplied to an upper blade side of a related cutter, which forwards the processed products to a common mixing area.

13. Device according to claim 11, wherein a further cutter is provided, with which cuts are worked into a solid product, into which the powdery processed products can fall.

14. Device according to claim 11, wherein a band-conveyor is provided, with which products or containers to be processed can be transported to the position of supply of the powdery processed products, such as the mixture.

15. Cutter according to claim 1, wherein the blade back comprises front surfaces at exposed ends, and wherein the first and second side surfaces are larger than the front surfaces.

16. Cutter according to claim 1, wherein the coupling element is U-shaped.

17. Cutter according to claim 1, wherein the first end piece extends perpendicularly to the mounting surface of the blade back.

18. Cutter according to claim 1, wherein the second end piece of the coupling element comprises a threaded bore in which a connecting member of the energy converter is held.

* * * * *